US006491002B1

(12) United States Patent
Adams

(10) Patent No.: US 6,491,002 B1
(45) Date of Patent: Dec. 10, 2002

(54) INTERMITTENT LINEAR MOTOR

(76) Inventor: Joseph Adams, 481 Beaver Point Road, Salt Spring Island, British Columbia (CA), V8K 2J9

( * ) Notice: Subject to any disclaimer, the term of this patent is extended or adjusted under 35 U.S.C. 154(b) by 0 days.

(21) Appl. No.: 09/891,960

(22) Filed: Jun. 26, 2001

(51) Int. Cl.[7] ..... F02B 71/00
(52) U.S. Cl. ..... 123/46 R
(58) Field of Search ..... 123/46 R, 46 A, 123/46 B, 465 C, 46 H

(56) References Cited

U.S. PATENT DOCUMENTS

| | | | | | |
|---|---|---|---|---|---|
| 3,394,295 | A | | 7/1968 | Cory | 318/115 |
| 3,441,819 | A | | 4/1969 | Palmero | 318/115 |
| 3,772,540 | A | | 11/1973 | Benson | 310/14 |
| 4,349,757 | A | | 9/1982 | Bhate | 310/15 |
| 4,483,474 | A | * | 11/1984 | Nikolich | 123/46 SC |
| 4,543,502 | A | | 9/1985 | Jarret et al. | 310/15 |
| 4,607,197 | A | | 8/1986 | Conrad | 318/115 |
| 4,665,868 | A | * | 5/1987 | Adams | 123/46 SC |
| 4,759,318 | A | * | 7/1988 | Adams | 123/46 SC |
| 4,827,163 | A | | 5/1989 | Bhate et al. | 310/15 |
| 4,924,123 | A | | 5/1990 | Hamajima et al. | 310/15 |
| 5,041,749 | A | | 8/1991 | Gaser et al. | 310/156 |
| 5,146,123 | A | | 9/1992 | Yarr | 310/15 |
| 5,295,388 | A | | 3/1994 | Fischer et al. | 73/12.09 |
| 5,389,844 | A | | 2/1995 | Yarr et al. | 310/15 |
| 5,438,227 | A | | 8/1995 | Satomi | 310/14 |
| 5,654,596 | A | | 8/1997 | Nasar et al. | 310/12 |
| 5,844,332 | A | | 12/1998 | Lee | 310/12 |
| 5,877,574 | A | | 3/1999 | Molnar | 310/215 |

* cited by examiner

*Primary Examiner*—Gene Mancene
*Assistant Examiner*—Hyder Ali
(74) *Attorney, Agent, or Firm*—Eugene Stephens & Associates

(57) ABSTRACT

The intermittent linear motor of this invention incorporates features which enhance the exhaust scavenging and cooling processes, as well as simplifying overall construction including a compression plenum below the piston where air displaced during a power stroke by the piston is immediately transferred through the combustion chamber allowing said compressed air to immediately begin scavenging exhaust gases as the piston is returned by a resilient member further displacing spent gases from the motor.

13 Claims, 4 Drawing Sheets

INTERMITTENT LINEAR MOTOR

FIELD OF THE INVENTION

This invention relates generally to the field of intermittent linear motors for use in combustion gas powered tools such as those used to drive fasteners.

BACKGROUND OF THE INVENTION

The cycle of the intermittent linear motor is different to that of a continuous running engine. It does not continue automatically, as would be the case in a reciprocating internal combustion engine. Instead, the intermittent linear motor's piston must be returned to, and remain in, an initial starting or rest position between each power stroke. Typically, a rod fitted to the piston engages a fastener or other load and mechanical energy is transmitted through the rod to drive a fastener or perform other useful work during the power stroke.

The piston is returned to its initial starting or rest position during a reciprocation stroke with a resilient member. This stroke is not generally used for compression purposes as in a conventional compression engine. Instead, the cylinder is vented during reciprocation so that the contents of the combustion chamber in the rest position are at or near atmospheric pressure. This is primarily done because holding a compressed charge for what may be extended periods between cycles has not proven practical. However, as a result of the inherent thermal-to-mechanical output inefficiencies resulting from this lack of compression, the combustion chambers of intermittent linear motors are required to be fairly large for a given power output.

These relatively large uncompressed combustion chambers of intermittent linear motors, as well as being inherently inefficient, are especially sensitive to the presence of residual exhaust gases from previous cycles. Failure to remove such residual gases will result in a diluted charge and deterioration of burn speed, which is critical when driving a fastener. Thus, unless such gases can be substantially completely removed and replaced with a clean air/fuel mixture, subsequent cycles will deliver significantly less power.

It is, therefore, necessary to provide some type of efficient exhaust scavenging system in devices utilizing intermittent linear motors. Such systems seek first to discharge exhaust gases from the tool as quickly as possible after combustion has been completed and useful work performed. This helps prevent the tool from overheating and also minimizes the amount of scavenging air required to completely clean out the remaining exhaust gases. There can be some variation due to the differing shapes and configurations of combustion chambers and their porting locations; however, it is generally necessary to pump clean air having a volume at least 2.5 times the volume of the combustion chamber in order to adequately clean out (i.e.—scavenge) exhaust gases prior to injecting fuel into the chamber. Representative prior art approaches to the problem of rapidly and efficiently scavenging exhaust gases can be seen in U.S. Pat. Nos. 4,403,722; 4,712,379; and 4,759,318.

These patents generally rely on a temperature drop in the gases remaining in the cylinder after exhaust gases have been allowed to escape following a power stroke. This temperature drop forms a partial vacuum, causing scavenging air to be drawn in through check valves at the ignition end of the combustion chamber. A critical problem associated with these systems is the speed with which the scavenging operations of this type can be accomplished. As it takes time and temperature drop for a vacuum to be realized after the fastener has been driven, hot gases are allowed to stay in the tool for long period of time up to 500 milliseconds. This causes the tool to heat up and lose power as well as severely limiting the operating speed of the tool.

SUMMARY OF THE INVENTION

In my current invention, a novel approach has been taken to address the problems described above, allowing rapid automatic operation in a simple device. Unlike my U.S. Pat. Nos. 4,712,379 and 4,403,722, which rely on a vacuum being set up and manual operations to complete their cycles, exhaust gases can be completely scavenged within 10 milliseconds in the cycle of my invention. This allows for very rapid cycling rates and minimal heating of the tool. It shares the advantages of my U.S. Pat. Nos. 4,759,318 and 4,665,868 as its cycle is initiated solely by electric signal without the need for manual pumps or valves, but does not require numerous complicated valves and seals. Thus, it represents a significant advance in efficiency and simplicity of operation over prior art devices.

The present invention relates to an improved combustion gas powered intermittent linear motor having a combustion chamber and, an associated piston reciprocating in a piston chamber; the piston powered in a power stroke by ignition of gas in the combustion chamber and biased to return to rest in a return stroke, when not powered by the ignition of gas. An exhaust valve is associated with the combustion chamber, which valve opens to exhaust spent combustion gases and air from the combustion chamber after combustion. A plenum chamber is provided, this plenum chamber being in fluid communication with the piston chamber below the piston remote from the combustion chamber. The plenum chamber is also in communication with the combustion chamber. The motor is configured so that:

(a) air is compressed in the piston chamber below the piston during the power stroke and this compressed air is compressed into the plenum chamber;

(b) then, as the combustion chamber pressure drops, the compressed air from the plenum chamber flows through the combustion chamber, and subsequently through the exhaust valve, scavenging the combustion chamber of spent combustion gases;

(c) as the plenum chamber pressure drops and the piston is on its return stroke, the piston draws in air from below it through an air inlet means in the piston chamber while exhaust gases above the piston are being forced out through the exhaust valve; and (d) as the pressure in the combustion chamber and plenum chamber return to substantially atmospheric pressure, all valves close to ready the motor for fuel injection and ignition.

BRIEF DESCRIPTION OF THE DRAWINGS

These and other advantages of the invention will become apparent upon reading the following detailed description and upon referring to the drawings in which.

Figure 1:
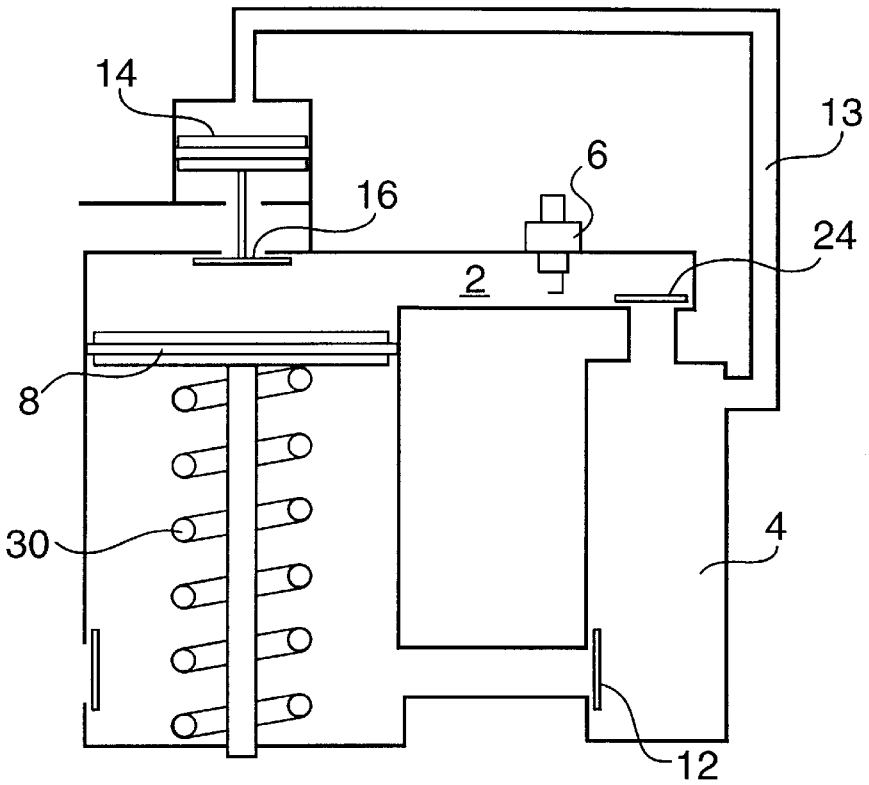
FIG. 1 is a schematic view of the system with the motor ready to fire.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the drawings, similar features have been given similar reference numerals.

Turning to FIG. 1 there is shown a schematic view of the system ready for ignition. Fuel injection and starting means are not shown for clarity. At this point the correct amount of a vapoured fuel such as Mapp gas or propane has been injected into the combustion chamber 2 in the correct proportion to create an explosive fuel/air change, and the tool is ready to fire as a result of a spark from spark plug 3. Typically a manual starting pump is connected preferably to the plenum chamber 4 to provide fresh air to the combustion chamber in the event that unburned gases or inaccurate fueling has left a polluted atmosphere in the combustion chamber as my previous U.S. Pat. Nos. 4,759,318 and 4,665,868 more fully describe.

Figure 2:
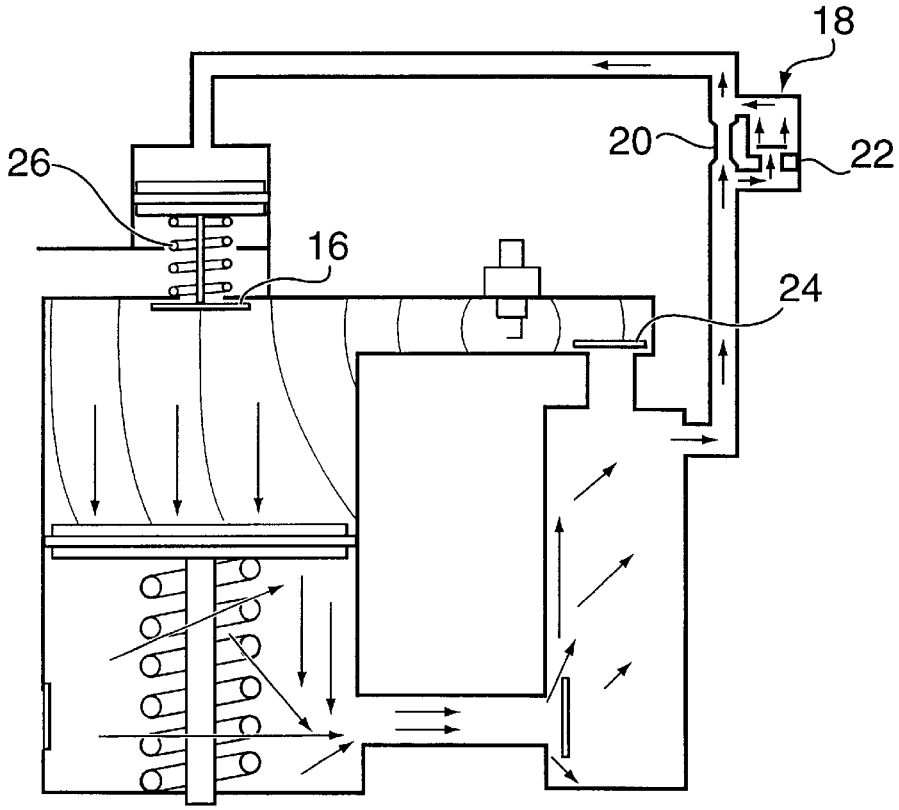
FIG. 2 is a schematic view of the system with the combustible mixture being ignited and the piston being driven down.

FIG. 2 shows the combustible mixture being ignited with a spark plug 6 and the piston 8 being driven down through its power stroke, and a fastener is driven or other useful work performed. Air from below the piston is being compressed into the scavenging plenum 4 through the plenum check valve 12. Pressure building in the plenum is also being communicated through signal line 13 to the exhaust valve actuator 14 biasing the exhaust valve 16 to open. If desired to more fully control the opening and closing timing of the exhaust valve 16, a check valve/orifice combination 18 (see FIG. 2) can be used to allow rapid opening of the valve whereby air flow to the actuator passes through an orifice 20 and past a check valve 22 during compression and only through the orifice as the pressure decreases during the cycle. (See FIG. 4.) The pressure inside the combustion chamber at this time is relatively high which holds the exhaust valve 16 closed. Also the combustion chamber check valve 24 is held closed against the plenum pressure with combustion pressure, the remaining pressure in the combustion chamber 2 being higher than the pressure in the plenum chamber 4.

Figure 3:
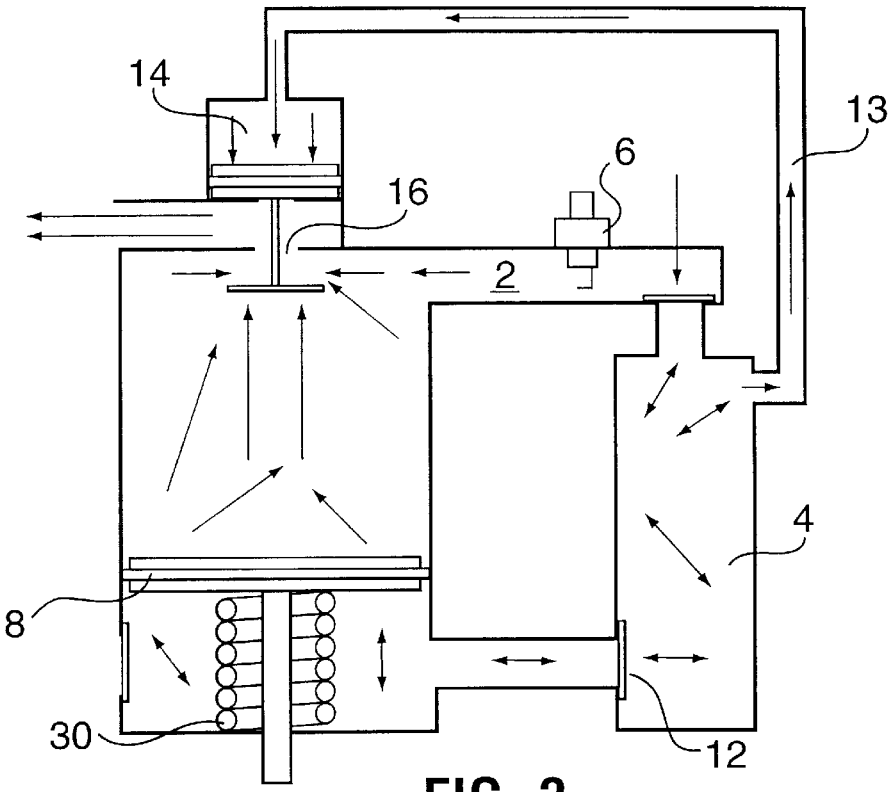
FIG. 3 is a schematic view of the system at the first stage of scavenging as the exhaust valve opens venting excess combustion pressure to atmosphere.

FIG. 3 shows the first stage of scavenging as the exhaust valve opens as a result of the high plenum pressure it references and lowered combustion chamber pressure. This vents the combustion chamber and as its pressure lowers towards atmospheric pressure, air begins flowing from the plenum 4 through the combustion chamber displacing exhaust gases from the combustion chamber and out through the open exhaust valve 16. There is also a spring 26 biasing the exhaust valve to close which is overcome by the plenum pressure on the diaphragm or actuation piston 16 of the actuator (not shown) and again as more fully described in my previous U.S. Pat. Nos. 4,759,318 and 4,665,868.

Simultaneously the piston 8 begins to return as the remaining combustion pressure falls and exhaust gases contained in the swept volume above the piston 8 are pushed out through the open exhaust valve. In a preferred embodiment the swept volume of the piston is roughly 2.5 or more times the volume of the combustion chamber 2. Typically the combustion chamber 2 is of a shape and location whereby there is a passageway between the combustion chamber and the swept volume (expansion volume) such that substantially all the scavenging air from the plenum chamber is used to displace exhaust gases from the combustion chamber and substantially all of the gases present in the swept volume above the piston are displaced by the piston through the exhaust valve.

As well as the spring 30 biasing the piston 8 upwards, a small amount of compressed air trapped in the unswept volume below the piston adds to the initial returning force applied to the piston.

Figure 7:
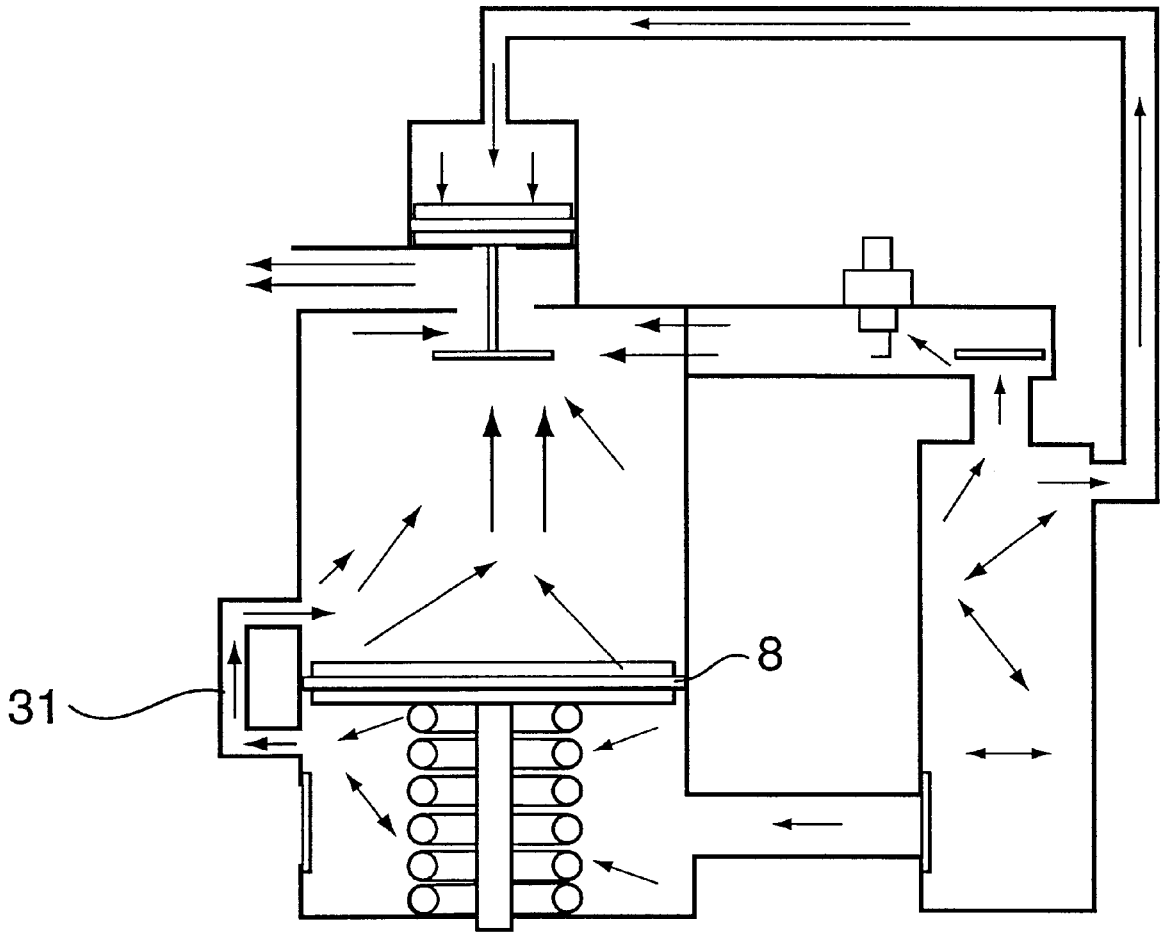
FIG. 7 is a schematic view of an alternative embodiment of the system according to the present invention, in which a bypass vent is provided to enable compressed air beneath the piston to enter the piston chamber above the piston.

Alternately, as shown in the embodiment of FIG. 7, this air compressed into the unswept volume below piston 8 can be bypassed as shown, into the volume above the piston as the piston reaches the bottom of its stroke, allowing this amount of otherwise unused air to assist in the cooling and scavenging process. This bypass vent 31 can be in the form of an external line as shown or simply be a channel cut into the cylinder wall at this location.

Figure 4:
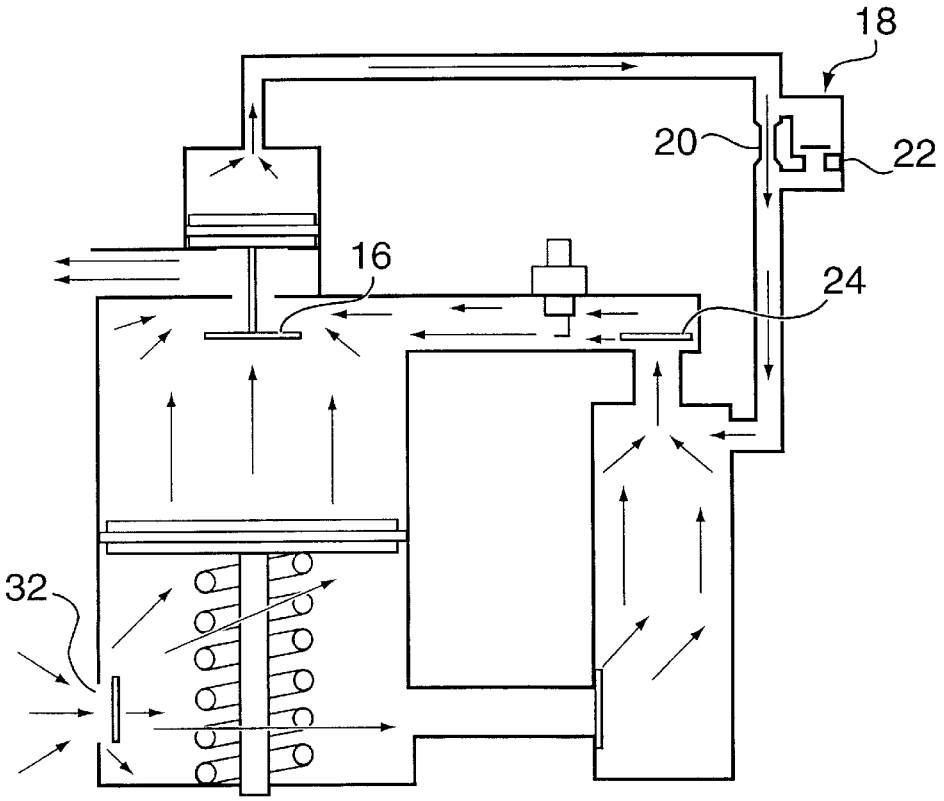
FIG. 4 is a schematic view of the system as the piston begins to return to its start position exhausting spent gases.

FIG. 4 shows the combustion chamber check valve 24 opening due to the pressure drop in the combustion chamber and air from the scavenging plenum being forced through the combustion chamber and out the exhaust valve scavenging exhaust gases with it. Simultaneously, the piston 8 starts to return by spring 30 or other means to its starting position, drawing in air below it through the air inlet valve 32 while forcing exhaust out through the exhaust valve 16 above it. Pressure in the scavenging plenum 4 is dropping at this time and air is beginning to flow back from the exhaust valve actuator 14. As previously stated, in line 13, it may be desirable to place an orifice or check valve/orifice combination 18 to tailor the opening and closing profiles of the exhaust valve 16 whereby the valve would open quickly but close slowly so that the plenum could drop to atmospheric pressure before the exhaust valve closes.

Air to be compressed in the next cycle is simultaneously draws in below the piston through an inlet means such as a check valve 32 as the piston returns. Once substantially all the pressure above atmospheric has been vented through the combustion chamber, the exhaust valve 16 closes.

Figure 5:
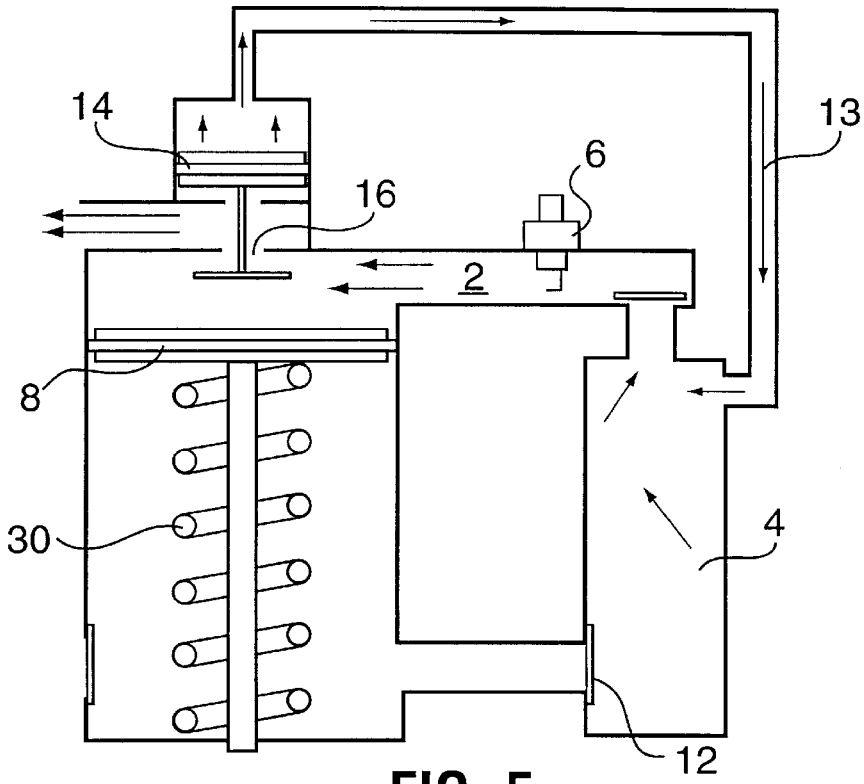
FIG. 5 is a schematic view of the system showing the piston at rest in its starting position and the remaining valves closing.

FIG. 5 shows the piston at rest in its starting position and the exhaust valve and combustion chamber 2 valves closing as the pressure in the plenum 4 drops to near atmospheric. Once these valves have closed, fuel can be injected and the cycle initiated again with a spark being delivered to the spark plug.

Figure 6:
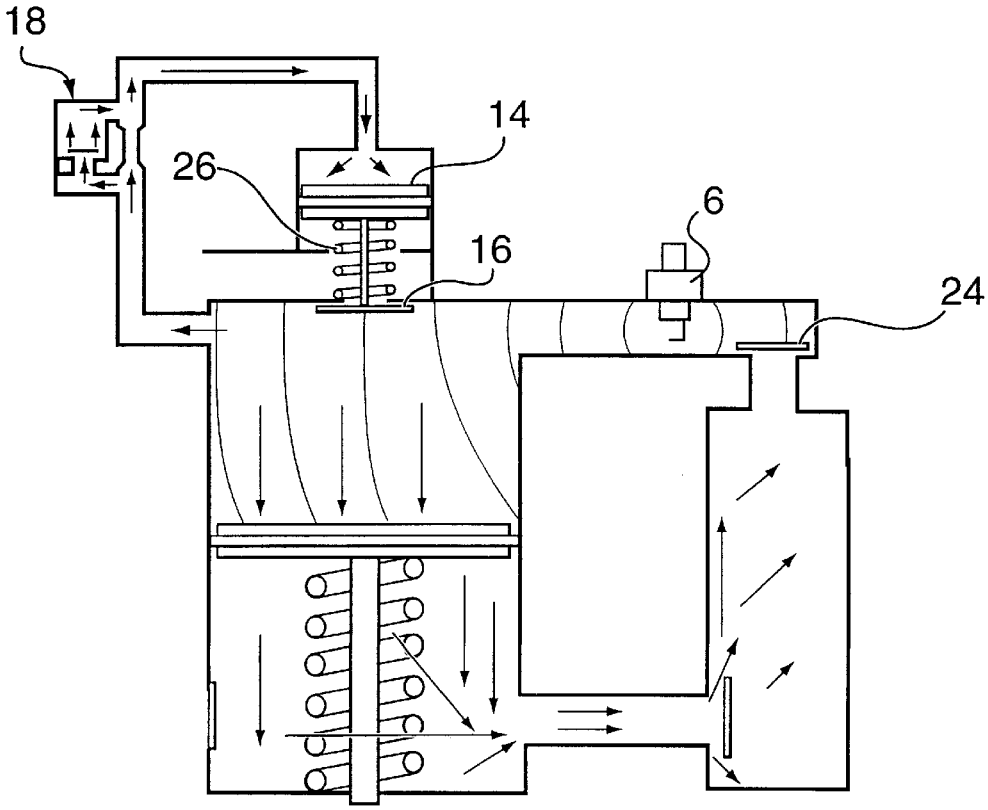
FIG. 6 is a schematic view of an alternative embodiment of the system according to the present invention, in which the system is arranged so that the pressure to acuate the exhaust valve is sourced from combustion pressure.

FIG. 6 shows an alternative embodiment of the motor according to the present invention wherein the combustion chamber 2 communicates with exhaust valve actuator 14, preferably through a check valve/orifice combination 18 (similar to that of FIG. 2), so that exhaust valve 16 is actuated to move to open position by combustion gases generated in chamber 2.

In operation, the very rapid cycling rates and minimal heating of the tool provide an efficient, effective intermittent linear motor.

Thus, it is apparent that there has been provided in accordance with the invention an intermittent linear motor that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

I claim:

1. In a combustion gas powered intermittent linear motor having a combustion chamber, an associated piston reciprocating in a piston chamber, the piston powered in a power stroke by ignition of gas in the combustion chamber and biased to return to rest in a return stroke, when not powered by the ignition of gas, an exhaust valve associated with the combustion chamber, which valve opens to exhaust spent combustion gases and air from the combustion chamber after combustion, the improvement characterized in that a plenum chamber is provided, this plenum chamber being in fluid communication with the piston chamber below the piston remote from the combustion chamber, the plenum chamber further being in further communication with a combustion chamber, the motor configured so that:

a. air is compressed in the piston chamber below the piston during the power stroke and this compressed air is compressed into the plenum chamber;

b. then, as the combustion chamber pressure drops, the compressed air from the plenum chamber flows through the combustion chamber, and subsequently through the exhaust valve, scavenging the combustion chamber of spent combustion gases;

c. as the plenum chamber pressure drops and the piston is on its return stroke, the piston draws in air from below it through an air inlet means in the piston chamber while exhaust gases above the piston are being forced out through the exhaust valve;

d. as the pressure in the combustion chamber and the plenum chamber return to substantially atmospheric pressure, said exhaust valve closes to ready the motor for fuel injection and ignition; and e. an air bypass vent associated with the piston chamber is arranged so as to allow air compressed in the piston chamber below the piston during the power stroke to enter the piston chamber above the piston as the piston reaches the bottom of its power stroke, thereby assisting in the scavenging of the combustion chamber of spent combustion gases and in cooling the combustion chamber during the scavenging process.

2. A motor according to claim 1, wherein the communication between the plenum chamber and the piston chamber is controlled by a normally closed plenum check valve, that check valve being in opened position to allow air compressed below the piston during the power stroke into the plenum chamber.

3. A motor according to claim 1, wherein the plenum is also in fluid communication with a normally closed exhaust valve actuator for the combustion chamber exhaust valve.

4. A motor according to claim 3, wherein compressed air from the plenum chamber is fed to the exhaust valve actuator to bias the exhaust to open as the pressure in the combustion chamber begins to decrease at or near the end of the power stroke.

5. A motor according to claim 3, wherein the fluid communication between the plenum and the exhaust valve actuator is through a check valve/orifice means which is arranged so that the exhaust valve opens quickly but closes slowly, whereby the plenum chamber can drop to substantially atmospheric pressure before the exhaust valve closes.

6. A motor according to claim 1, wherein the swept volume of the piston is equal to or greater than two times the volume of the combustion chamber.

7. A motor according to claim 1, wherein the exhaust valve is spring biased to its closed position.

8. A motor according to claim 1, wherein the combustion chamber check valve is spring biased to its closed position.

9. A motor according to claim 1, wherein the exhaust valve is mechanically opened by a fluid driven piston actuator or diaphragm.

10. A motor according to claim 3, wherein the plenum is in fluid communication with a piston or diaphragm operated valve actuator for the combustion chamber exhaust valve.

11. A motor according to claim 1, wherein the combustion chamber is in fluid communication with a normally closed exhaust valve actuator and arranged so that the compression chamber pressure biases the exhaust valve actuator to open the exhaust valve at or near the end of a power stroke as the pressure in the combustion chamber decreases.

12. A motor according to claim 1, wherein the air inlet means is in the form of a check valve.

13. A motor according to claim 1 wherein a portion of the air compressed in the piston chamber below the piston adds to an initial returning force applied to the piston on its return stroke.

* * * * *